US008568108B2

(12) United States Patent
Maier

(10) Patent No.: US 8,568,108 B2
(45) Date of Patent: Oct. 29, 2013

(54) FLUID CHANNELING DEVICE FOR BACK-TO-BACK COMPRESSORS

(75) Inventor: William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 13/283,806

(22) Filed: Oct. 28, 2011

(65) Prior Publication Data

US 2012/0063885 A1 Mar. 15, 2012

Related U.S. Application Data

(63) Continuation of application No. 12/407,962, filed on Mar. 20, 2009.

(51) Int. Cl.
*F04B 25/00* (2006.01)
*F04D 27/02* (2006.01)

(52) U.S. Cl.
USPC ..... 417/245; 415/1

(58) Field of Classification Search
USPC ..... 417/245; 415/1
See application file for complete search history.

(56) References Cited

U.S. PATENT DOCUMENTS

2008/0031732 A1* 2/2008 Peer et al. ..... 415/201

* cited by examiner

*Primary Examiner* — Anh Mai
*Assistant Examiner* — Brenitra M Lee
(74) *Attorney, Agent, or Firm* — Edmonds & Nolte, PC

(57) ABSTRACT

A fluid channeling device including a channeling body, an axial transfer channel, and a radial outlet channel. The channeling body includes first and second annular body sections spaced axially apart and a tubular body section extending between the first and second body sections. The axial transfer channel is defined axially through the channeling body, and is configured to fluidly couple a first compression assembly with a second compression assembly. The radial outlet channel is defined radially through the channeling body and is configured to fluidly couple the second compression assembly with an outlet.

20 Claims, 6 Drawing Sheets

FLUID CHANNELING DEVICE FOR BACK-TO-BACK COMPRESSORS

CROSS-REFERENCE TO RELATED APPLICATIONS

This application is a continuation of U.S. patent application having Ser. No. 12/407,962, filed on Mar. 20, 2009. This priority application is incorporated herein by reference in its entirety.

BACKGROUND

The present invention relates to fluid machinery, and more particularly to fluid channeling components for compressors.

Fluid machinery, such as a centrifugal compressor, generally includes a casing, a rotatable shaft extending through the casing, one or more impellers mounted on the shaft for pressurizing fluid, a driver such as an electric motor, and various supporting components, such as bearings, seals, etc. One type of compressor, referred to as a "back-to-back" compressor, includes two separate compression assemblies, each of which includes one or more impellers arranged in an opposing manner on the same shaft so as to balance thrust induced on each compression section. Fluid being pressurized may pass through a first compression section, then through a second, opposing compression section, and is thereafter directed out of the casing for subsequent use or additional processing. Typically, external piping is required to transfer fluid from the outlet of the first compression assembly to the inlet of the second compression assembly, which requires additional penetrations of the casing for piping inlet(s) and outlet(s) and increases the overall size of the compressor assembly.

SUMMARY

Embodiments of the disclosure may provide an exemplary fluid channeling device for a compressor including a channeling body disposed in an interior chamber of the compressor. The exemplary fluid channeling device also includes axial transfer channels extending axially through channeling body, and configured to fluidly couple an outlet of a first compression assembly of the compressor with an inlet of a second compression assembly of the compressor. The exemplary fluid channeling device also includes radial outlet channels extending radially through the channeling body and configured to fluidly couple an outlet of the second compression assembly with an outlet of a casing of the compressor. Further, the channeling body is configured to prevent intermixing of a fluid between the axial transfer channels and the radial outlet channels, while allowing the fluid to flow therethrough.

Embodiments of the disclosure may further provide an exemplary fluid channeling device including a channeling body, an axial transfer channel, and a radial outlet channel. The channeling body includes first and second annular body sections spaced axially apart and a tubular body section extending between the first and second body sections. The axial transfer channel is defined axially through the channeling body, and is configured to fluidly couple a first compression assembly with a second compression assembly. The radial outlet channel is defined radially through the channeling body and is configured to fluidly couple the second compression assembly with an outlet.

Embodiments of the disclosure may further provide an exemplary compressor including a casing, first and second compression assemblies, and a fluid channeling device. The casing has an interior chamber, a central axis extending through the interior chamber, and an outlet. The first and second compression assemblies are disposed in the interior chamber, and are spaced axially apart along the central axis. Each of the first and second compression assemblies has an inlet, an outlet, and at least one compressor stage. The fluid channeling device includes a channeling body that is disposable within the interior chamber, and axial transfer channels that are configured to fluidly couple the outlet of the first compression assembly with the inlet of the second compression assembly. Further, the fluid channeling device includes radial outlet channels that are configured to fluidly couple the outlet of the second compression assembly with the outlet of the casing.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features is arbitrarily increased or reduced for clarity of discussion.

DETAILED DESCRIPTION

Figure 1:
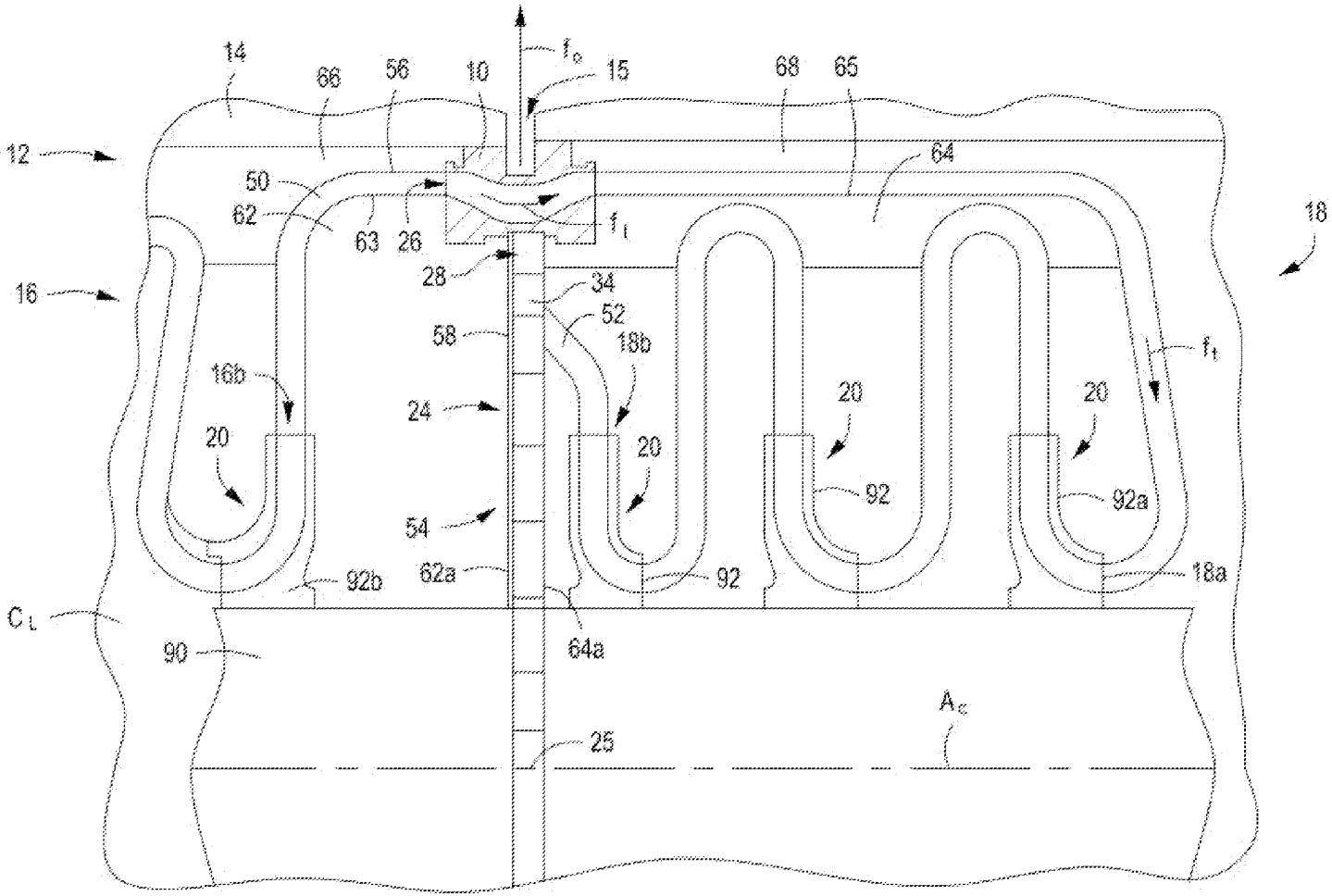
FIG. 1 illustrates a broken-away, axial cross-sectional view of an exemplary embodiment of a compressor, in accordance with the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows includes embodiments in which the first and second features are formed in direct contact, and also includes embodiments in which additional features is formed interposing the first and second features, such that the first and second features may not be in direct contact. Finally, the exemplary embodiments presented below may be combined in any combination of ways, i.e., any element from one exemplary embodiment is used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure are exact or approximate values unless otherwise specifically stated. Accordingly, various embodiments of the disclosure may deviate from the numbers, values, and ranges disclosed herein without departing from the intended scope.

Referring now to the drawings in detail, wherein like numbers are used to indicate like elements throughout, there is shown in FIG. 1 an exemplary embodiment of a fluid channeling device 10, shown broken away along the radial middle, for a compressor 12 that includes a casing 14 with an interior chamber $C_C$, a central axis $A_C$ extending through the interior chamber $C_C$, and an outlet 15. First and second compression assemblies 16, 18 may be disposed within the interior chamber $C_C$ so as to be spaced apart along the central axis $A_C$. The first and second compression assemblies 16, 18 may be oriented in a "back-to-back" arrangement, as is know in the art of centrifugal compressors. Each compression assembly 16, 18 has at least one compressor stage 20 and an outlet 16*b*, 18*b*, respectively. The first compression assembly 16 has an inlet (not shown) and the second compression assembly 18 has an inlet 18*a*.

The fluid channeling device 10 includes a channeling body 24, which may be disposable in the interior chamber $C_C$ between the first and second compression assemblies 16, 18. The fluid channeling device 10 may include one or more axial transfer channels 26 and/or one or more radial outlet channels 28. In the illustrated exemplary embodiment, the fluid channeling device 10 has a plurality of axial transfer channels 26, and a plurality of radial outlet channels 28. Each axial transfer channel 26 may extend through the channeling body 24, fluidly coupling the outlet 16*b* of the first compression assembly 16 with the inlet 18*a* of the second compression assembly 18, and each radial outlet channel 28 may extend through the channeling body 24, fluidly coupling the outlet 18*b* of the second compression assembly 18 with the outlet 15 of the casing 14. The channeling body 24 may further have a central axis 25, which may be collinear with the central axis $A_C$.

Figure 2:
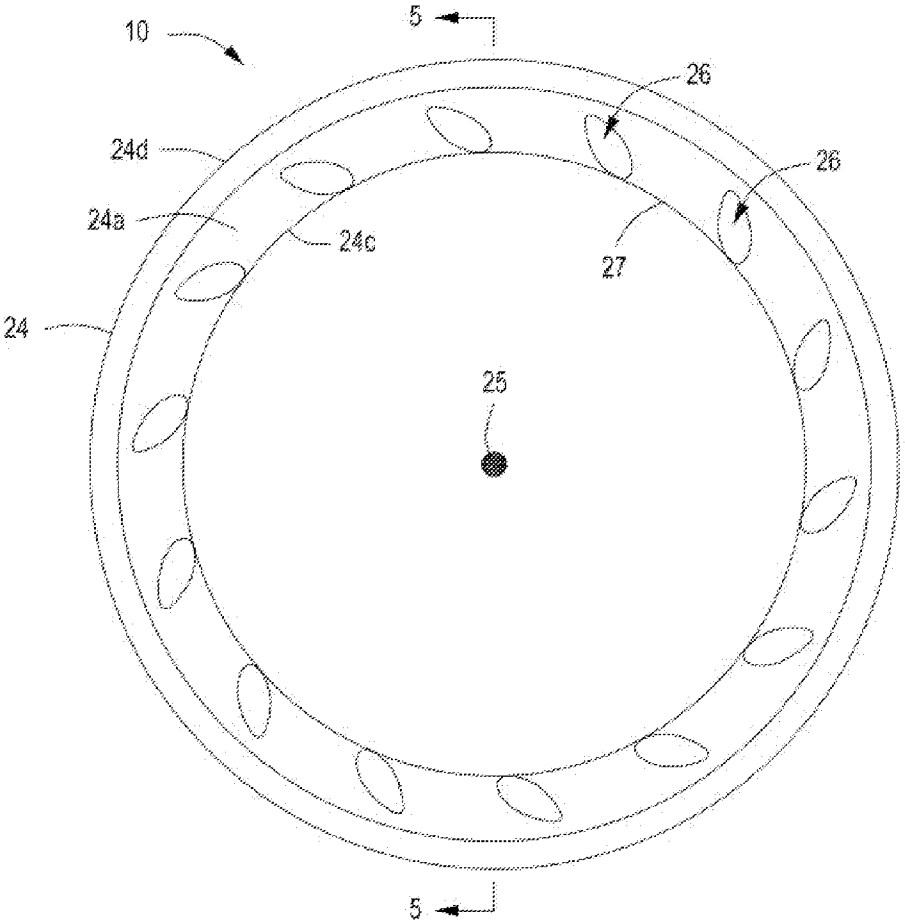
FIG. 2 illustrates a front plain view of an exemplary embodiment of a fluid channeling device in accordance with the disclosure.

FIG. 2 illustrates an exemplary embodiment of the fluid channeling device 10 viewed from the upstream axial perspective (i.e., from the perspective of the first compression assembly 16, as shown in FIG. 1). The channeling body 24 may be generally annular and disposed around the central axis 25. The channeling body 24 has a first axial end 24*a*, which may face the first compression assembly 16 (shown in FIG. 1). The channeling body 24 may also have inner and outer circumferential sides 24*c*, 24*d* disposed around the central axis 25, with the outer circumferential side 24*d* spaced radially apart from the inner circumferential side 24*c*, defining the radial extents of the channeling body 24. The axial transfer channels 26 extend into the channeling body 24, and may extend through it, as described below. Further, the inner circumferential side 24*c* of the channeling body 24 may define a central bore 27, which may extend through the channeling body 24.

Figure 3:
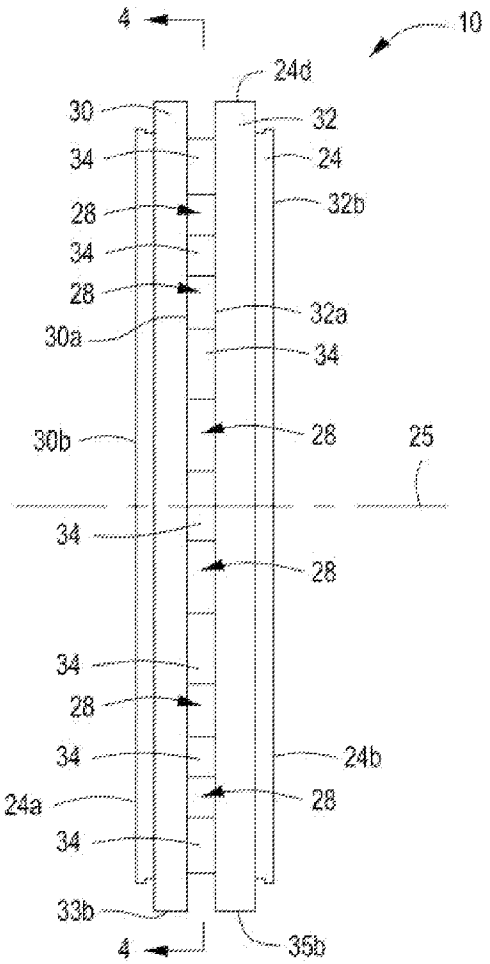
FIG. 3 illustrates a side plain view of an exemplary embodiment of a fluid channeling device in accordance with the disclosure.

FIG. 3 illustrates an exemplary embodiment of the channeling body 24 viewed from the radial perspective (i.e., orthogonal to the previously described axial view). The exemplary channeling body 24 has the first axial end 24*a*, as described with reference to FIG. 2, and also a second axial end 24*b*, which may face the second compression assembly 18 (shown in FIG. 1). Together, the first and second axial ends 24*a*, 24*b* may define the axial extents of the channeling body 24, with the central axis 25 extending through the channeling body 24.

The channeling body 24 may further include first and second annular body sections 30, 32, which are axially aligned and spaced axially apart along the central axis 25. As shown, the outer circumferential side 24*d* may be broken apart between the first and second annular body sections 30, 32, i.e., the outer circumferential side 24*d* may not be continuous, but in other embodiments, it may be continuous. The first and second annular body sections 30, 32 may be generally circular and may have facing inner axial ends 30*a*, 32*a*, respectively, opposing outer axial ends 30*b*, 32*b*, respectively, and outer circumferential surfaces 33*b*, 35*b*, respectively. One or more tubular body sections 34 may extend between and connect the first and second annular body sections 30, 32. In an exemplary embodiment, the channeling body 24 includes a plurality of the tubular body sections 34. The radial outlet channels 28 may extend radially through the channeling body 24, and may be defined radially between, i.e., partitioned by, the tubular body sections 34. More particularly, in an exemplary embodiment, the radial outlet channels 28 may be defined between tubular body sections 34 that are circumferentially adjacent, which may be better appreciated when described below in reference to FIG. 6. Further, the radial transfer channels 28 may be defined axially between the first and second annular body sections 30, 32.

Figure 4:
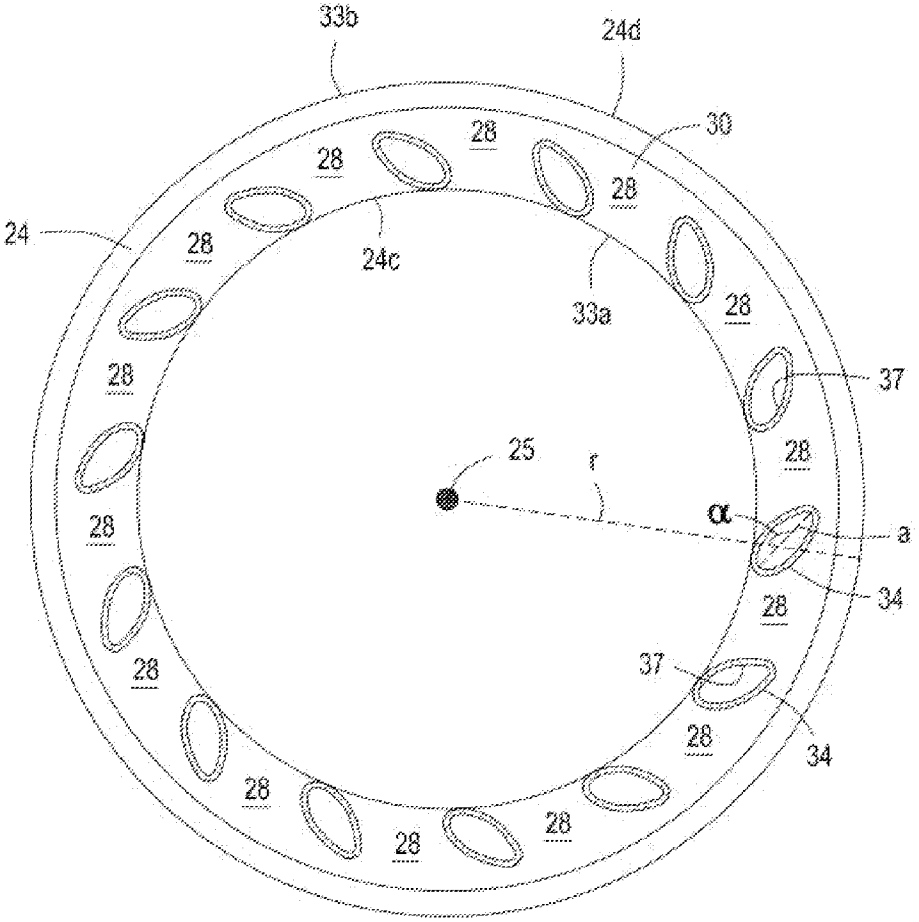
FIG. 4 illustrates a view through line 4-4 of FIG. 3, in accordance with the disclosure.

FIG. 4 illustrates a broken-away view, along line 4-4 of FIG. 3, of the axial middle of the exemplary embodiment of the channeling body 24, viewed toward the first annular body section 30. The reverse view, toward the second annular body section 32, is not illustrated, but may be substantially similar to FIG. 4. As shown, the tubular body sections 34 may be spaced apart circumferentially around the central axis 25. As described with reference to FIG. 3, the radial outlet channels 28 may be defined between circumferentially adjacent tubular body sections 34. Thus, the radial outlet channels 28 may extend radially between the inner circumferential side 24*c* and the outer circumferential side 24*d*, between the circumferentially spaced apart tubular body sections 34.

Further, the tubular body sections 34 may each have a radial cross section that is elongated, and which may form an aerofoil shape. In other embodiments, the cross-section of the tubular body sections 34 may elliptical, wherein the elliptical shape has at least about a 2:1 aspect ratio between the major and minor diameters. Further, the tubular body sections 34 may each have a major axis a. The tubular body sections 34 may each be disposed at an angle $\alpha$ with respect to a radius r drawn to extend radially outwards from the central axis 25. This angle $\alpha$ may vary among the tubular body sections 34, or may be the same throughout. In an exemplary embodiment, the angle $\alpha$ may be chosen to orient the tubular body sections 34 to align with a radial outlet flow $f_o$ (described in detail below) to minimize drag losses.

Figure 5:
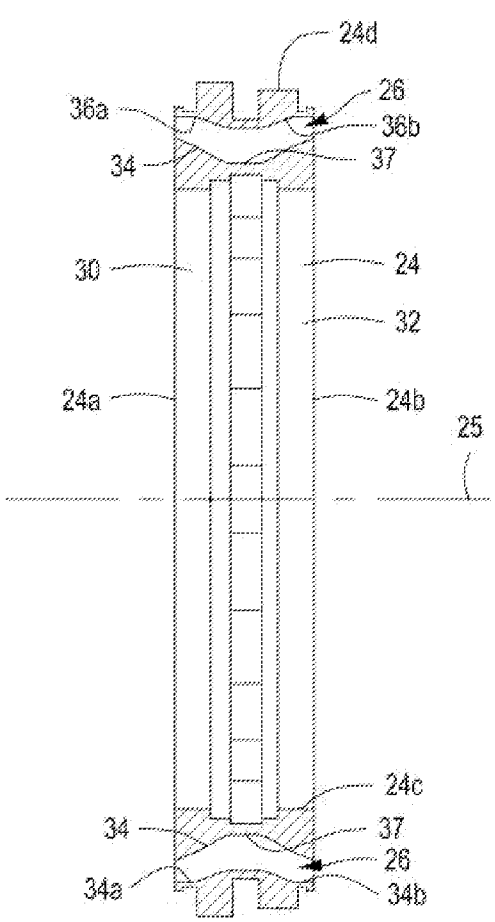
FIG. 5 illustrates a view through line 5-5 of FIG. 2, in accordance with the disclosure.

FIG. 5 illustrates a broken away view, along line 5-5 of FIG. 2, of an exemplary embodiment of the channeling body 24. As shown, each of the tubular body sections 34 may extend between the first and second annular body sections 30, 32, between the inner and outer circumferential sides 24*c*, 24*d*, and may define a central bore 37 therein, providing at least a portion of the axial transfer channels 26. Further, the first annular body section 30 may have first openings 36*a*, and the second annular body section 32 may have second openings 36*b*. It will be appreciated that the first and second openings 36*a*, 36*b* may each be spaced apart circumferentially around the central axis 25, such that they are aligned with the tubular body sections 34.

The tubular body sections 34 may have first and second open ends 34*a*, 34*b*. The first open end 34*a* of each tubular body section 34 may be disposed in, and/or integrally connected with, one of the first openings 36*a*. Likewise, the second open end 34*b* of each tubular body section 34 may be disposed in, and/or integrally formed with, one of the second openings 36*a*. Accordingly, the tubular body sections 34 may each extend between the first and second annular body sections 30, 32, with the tubular body sections 34, and the first and second openings 36*a*, 36*b*, circumferentially spaced apart around the central axis 35, and axially aligned. The axial transfer channels 26 may thereby extend axially through the channeling body 24, beginning at the first axial end 24*a*, extending through the first annular section 30, via the first openings 36*a*, through the central bore 37 of each of the tubular body sections 34, through the second annular body section 32 via the second openings 36*b*, and through the second axial end 24*b*.

Figure 6:
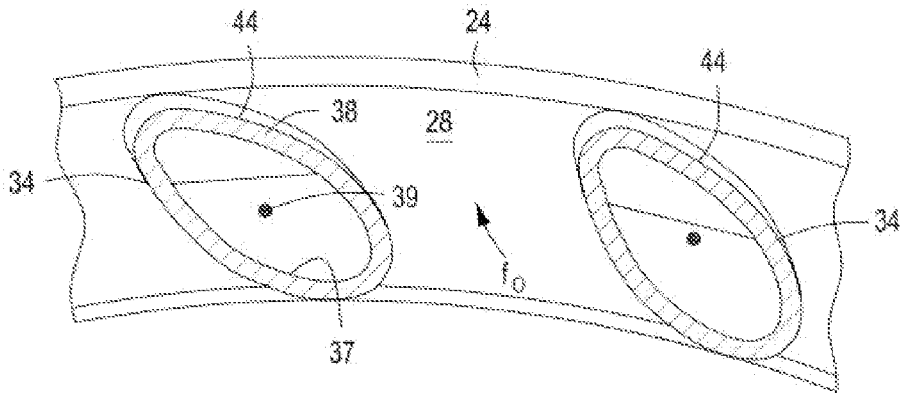
FIG. 6 illustrates a broken-away, enlarged view of a portion of FIG. 4, in accordance with the disclosure.

FIG. 6 illustrates a raised perspective view of a portion of the exemplary embodiment of the channeling body 24 shown in FIG. 4, illustrating two circumferentially adjacent tubular body sections 34. As shown, the tubular body sections 34 may have enclosed sidewalls 38, defining the central bores 37 on the inside and defining exterior surfaces 44 on the outside. The exemplary tubular body sections 34, having the central bores 37, each define an axis 39 extending therein, which is described in greater detail with reference to FIG. 7. The shown exemplary embodiment of the radial outlet channel 28 is bounded by adjacent tubular body sections 34, and more particularly, is bounded by the exterior surfaces 44 of the adjacent tubular body sections 34. While the tubular body sections 34 may be elongated as described with reference to FIG. 4, they may, however, produce the exemplary radial outlet channels 28 each having a cross section which is substantially rectangular. This can also be appreciated from radial views of the fluid channeling device 10 showing rectangular radial outlet channels 28, such as FIGS. 3 and 5. In an exemplary embodiment, the remaining radial outlet channels 28 are substantially similarly disposed around the channeling body 24, as can be appreciated from FIG. 4; however, departures from this arrangement, are contemplated herein.

Figure 7:
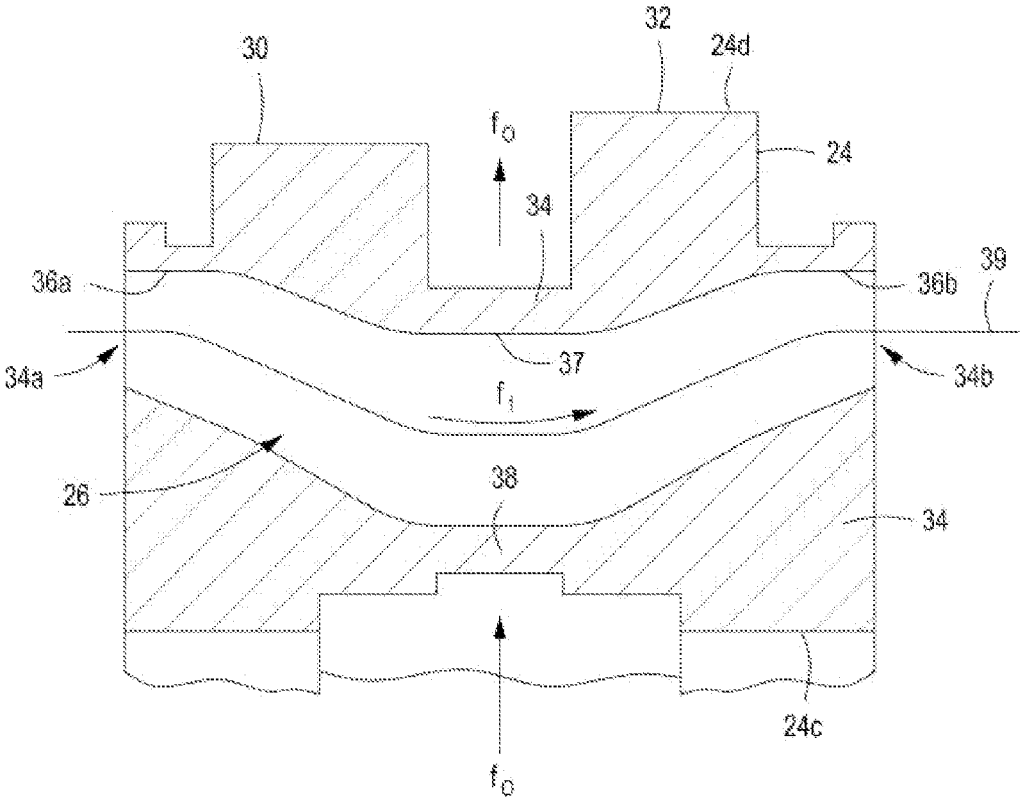
FIG. 7 illustrates a broken-away, enlarged view of a portion of FIG. 5, in accordance with the disclosure.

FIG. 7 illustrates an enlarged view of a portion of FIG. 5, illustrating an exemplary embodiment of one of the axial transfer channels 26 extending through the channeling body 24. The illustrated exemplary embodiment of the axial transfer channel 26 includes one of the tubular body sections 34, which has the enclosed sidewall 38, and the central axis 39 extending longitudinally through the central bore 37. As described above, the tubular body section 34 may extend between the first and second annular body sections 30, 32. Further, the tubular body section 34 may have the first and second open ends 34*a*, 34*b*, which are disposed in the first and second openings 36*a*, 36*b*. The tubular body section 34 may be disposed between the inner circumferential side 24*c* and the outer circumferential side 24*d* and may extend partially or completely therebetween. The central axis 39 may be axially straight, or may be curved, as shown. The axial transfer channel 26 thus may extend through the first opening 36*a* on the first annular body section 30, into the tubular body section 34 via the first open end 34*a*. The axial transfer channel 26 may further extend along the central bore 37, and through the second annular body section 32 via the second open end 34*b* and the second opening 36*b*. In exemplary embodiments having multiple tubular body sections 34, the tubular body sections 34 may have a substantially similar structure to that just described.

Referring again to FIG. 1, the compressor 12 includes first and second flow passages 50, 52 that are defined within the casing 14 and may cross or intersect to define a generally annular channel 54, which may also be described as a generally annular passage intersection. The first flow passage 50 may direct fluid through the outlet 16*b* of the first compression assembly 16 to the inlet 18*a* of the second compression assembly 18. The second flow passage 52 may direct fluid through the outlet 18*b* of the second compression assembly 18 to the outlet 15 of the casing 14. The channeling body 24 may be disposable within the generally annular channel 54.

In an exemplary embodiment, the compressor assembly 12 also includes first and second cylindrical members 62, 64 that are disposed within the interior chamber $C_C$ and are spaced axially apart so that they may define a generally radial section 58 of the second flow passage 52. Each of the first and second cylindrical members 62, 64 has an outer circumferential surface 63, 65, respectively, which may together at least partially define an annular section 56 of the first flow passage 50. Further, the first and second cylindrical members 62, 64 may have axial ends 62*a*, 64*a*, which may also be described as facing ends. The channeling body 24 may be disposable between the first and second cylindrical members 62, 64, and may partially overlap or extend about the first and second cylindrical members 62, 64. In an exemplary embodiment, the first cylindrical member 62 is configured to receive a seal assembly (not shown) or other compressor hardware (e.g., a bearing assembly or the like, not shown) and the second cylindrical member 64 may be a casing for enclosing the second compression assembly 18.

Further, the compressor 12 may include first and second outer sleeve members 66, 68, which may each be disposed about a separate one of the first and second cylindrical members 62, 64, respectively, such that the first flow passage 50 may be at least partially defined. The compressor assembly 12 also includes a shaft 90 that may extend centrally through the casing 14. Each of the first and second compression assemblies 16, 18 includes at least one impeller 92 mounted upon the shaft 90. In an exemplary embodiment, one of the impellers 92 may be a final stage impeller 92*b* that may provide the outlet 16*b* of the first compression assembly 16 and may be fluidly coupled with the first flow passage 50. Further, another one of the impellers 92 may be a first stage impeller 92*a* that may provide the inlet 18*a* of the second compression assembly 18. The second compression assembly 18 may also include a volute providing at the outlet 18*b*. The volute may be configured to discharge fluid from the second compression assembly 18 into the second flow passage 52.

Figure 8:
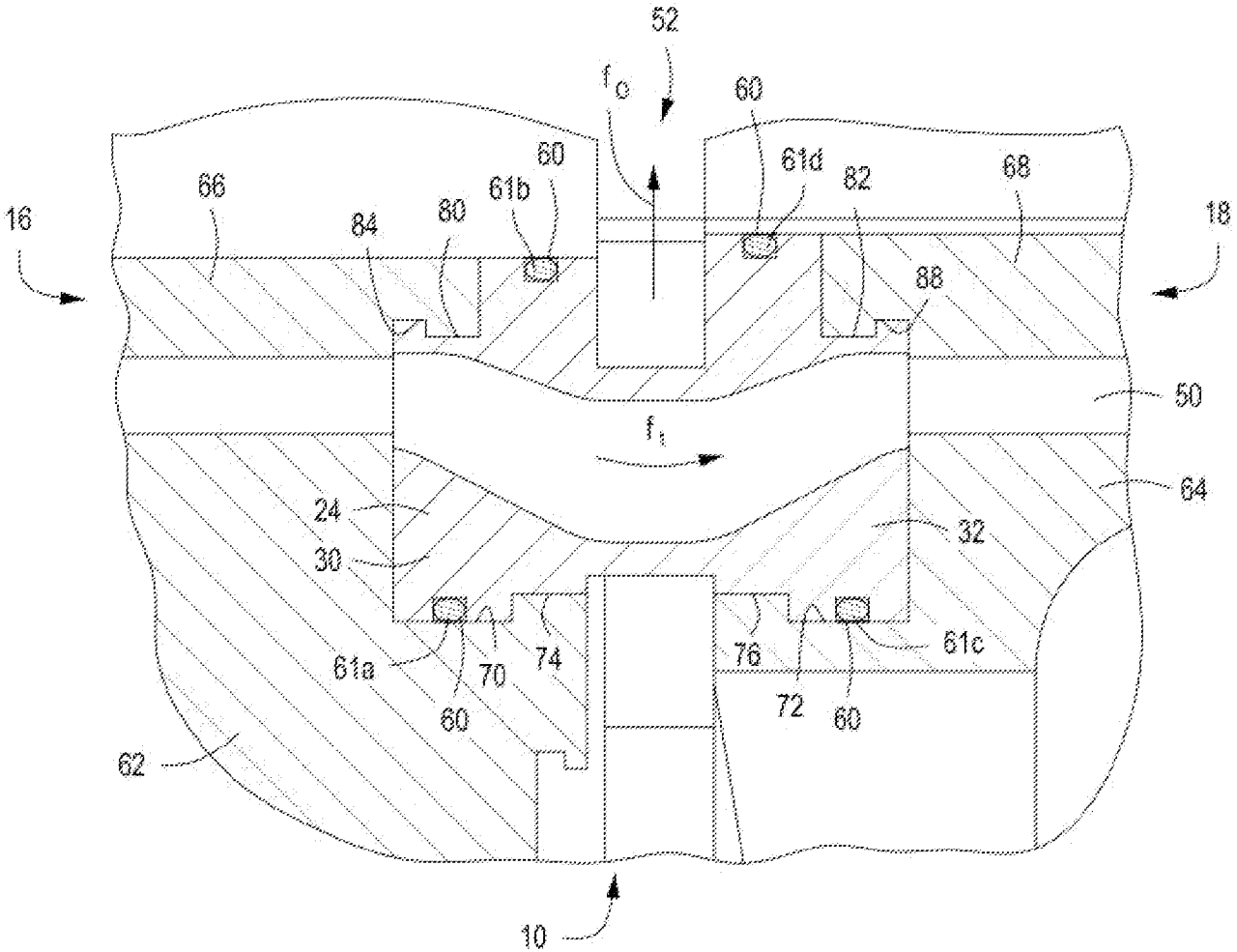
FIG. 8 illustrates a broken-away, enlarged view of a portion of FIG. 1, in accordance with the disclosure.

FIG. 8 illustrates an enlarged view of a portion of FIG. 1, showing an exemplary embodiment of a portion of the channeling body 24, which may be interlocked between the first and second compressor assemblies 16, 18. More particularly, the first cylindrical member 62 may include a shoulder 74, and the first annular body section 30 may include a complementary shoulder 70, with the shoulder 74 engaging the complementary shoulder 70. Similarly, the second cylindrical member 64 may include a shoulder 76, and the second annular body section 32 may include a complementary shoulder 72, with the shoulder 76 engaging the complementary shoulder 72. Together, the shoulders 70, 72, 74, 76 may thusly interlock to substantially prevent axial or radial displacement of the channeling body 24.

Additionally, the first annular body section 30 may be at least partially disposed in the first outer sleeve member 66, and the second annular body section 32 may be at least partially disposed in the second outer sleeve member 68, and, further, the first and second annular body sections 30, 32 may be interlocked therein. More particularly, the first outer sleeve member 66 may include a shoulder 80, and the first annular body section 30 may include a complementary shoulder 84, with the shoulder 80 engaging the complementary shoulder 84. Likewise, the second outer sleeve member 68 may include a shoulder 82, and the second annular body section 32 may include a complementary shoulder 88, with the shoulder 82 engaging the complementary shoulder 88. Together, the shoulders 80, 82, 84, 88, may thusly interlock to substantially prevent axial or radial displacement of the channeling body 24.

In an exemplary embodiment, the fluid channeling device 10 also includes at least one sealing member 60, and, as shown, the fluid channeling device 10 may include four sealing members 60. The four sealing members 60 may be a first sealing member 61*a* disposed between the first annular body section 30 and the first cylindrical member 62, a second sealing member 61*b* disposed between the first annular body section 30 and the first outer sleeve member 66, a third sealing member 61*c* disposed between second annular body section 32 and the second cylindrical member 64, and a fourth sealing member 61*d* disposed between the second annular body section 32 and the second outer sleeve member 68. Accordingly, the four sealing members 61*a-d* (collectively 60) may seal any clearance to substantially prevent flow from the first flow passage 50 into the second flow passage 52, and vice versa. Further, each sealing member 60 may be elastomeric, and may be provided by a commercially available "O-ring."

Figure 9:
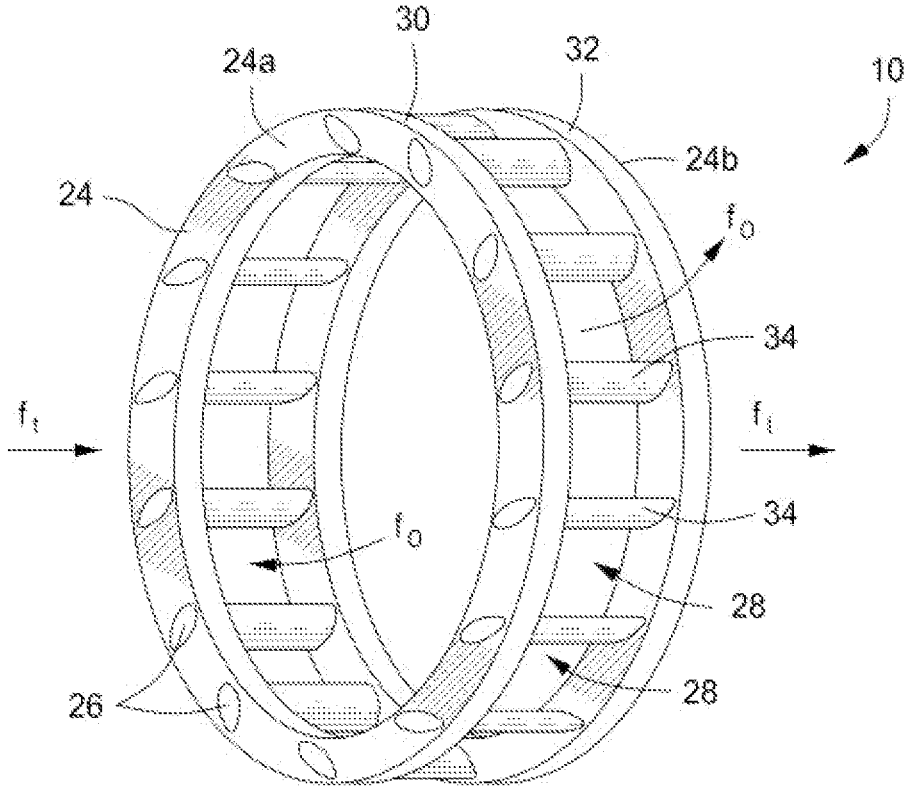
FIG. 9 illustrates an isometric view of an exemplary embodiment of a fluid channeling device in accordance with the disclosure.

FIG. 9 illustrates an isometric view of an exemplary embodiment of the fluid channeling device 10. As shown, the fluid channeling device 10 includes the channeling body 24, which may include the first and second annular body sections 30, 32. The first and second axial ends 24*a*, 24*b*, may define the axial extents of the channeling body 24, and the first and second annular body sections 30, 32 may be aligned and spaced apart axially, with the tubular body sections 34 extending therebetween. The axial transfer channels 26 may extend axially through the channeling body 24, as described with reference to FIG. 7. Further, the radial outlet channels 28 may extend radially through the channeling body 24, possibly between adjacent tubular body sections 34, as described with reference to FIGS. 3 and 4.

Referring to FIGS. 1 and 5-9, the fluid channeling device 10 operates to channel two flows of fluid through the channeling body 24, allowing the flows to traverse the annular channel 54, while substantially preventing intermixing. The first flow is an axial transfer flow $f_t$, which begins in the first compression assembly 16, and flows to the second compression assembly 18. The second flow is the radial outlet flow $f_O$, which flows from the outlet of the second compression assembly 18 through the outlet 15 of the casing 14. The axial transfer flow $f_t$ may traverse the region between the first and second compressor assemblies 16, 18 through the axial transfer channels 26, which have been described in detail above. The radial outlet flow $f_O$ may travel through the radial outlet channels 28, possibly between the tubular body sections 34. Thus, it can be seen that the radial outlet flow $f_O$ and the axial transfer flow $f_t$ may travel through the channeling body 24 in orthogonal directions, but since the fluid channeling device 10 may be configured to sealingly channel the two fluid flows $f_t$, $f_O$ therein, the fluid flows $f_t$, $f_O$ may be prevented from substantially intermixing, without necessitating additional perforations in the casing 14 of the compressor 12.

The foregoing has outlined features of several embodiments so that those skilled in the art is better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. An apparatus for channeling fluid in a compressor, comprising:

an annular body comprising first and second annular body sections, and a plurality of tubular body sections extending axially between the first and second annular body sections, and the annular body defining transfer channels extending axially therethrough and outlet channels extending radially therethrough, the transfer channels being in fluid communication with first and second compression assemblies so as to direct fluid from the first compression assembly toward the second compression assembly, and the outlet channels being in fluid communication with the second compression assembly and a compressor outlet.

2. The apparatus of claim 1, wherein the annular body is contained in an interior chamber of the compressor and is disposed axially between the first and second compression assemblies.

3. The apparatus of claim 1, wherein fluid flowing through the transfer channels is prevented from intermixing with fluid flowing through the outlet channels.

4. The apparatus of claim 1, wherein the annular body defines an inner diameter and an outer diameter, the outlet channels extending radially between the inner and outer diameters.

5. The apparatus of claim 1, wherein the outlet channels are defined axially between the first and second annular body sections.

6. The apparatus of claim 5, wherein each tubular body section of the plurality of tubular body sections at least partially defines one of the transfer channels.

7. The apparatus of claim 6, wherein the plurality of tubular body sections are circumferentially spaced apart such that the outlet channels extend between the plurality of tubular body sections.

8. The apparatus of claim 6, wherein the plurality of tubular body sections are aerofoil shaped and disposed at an acute angle relative a radial line defined by the annular body.

9. The apparatus of claim 6, wherein the first annular body section has first openings and the second annular body section has second openings, and wherein each tubular body section of the plurality of tubular body sections has a first open end fluidly communicating with one of the first openings and a second open end fluidly communicating with one of the second openings.

10. The apparatus of claim 6, wherein at least one of the first and second compression assemblies includes one or more impellers.

11. A fluid channeling device for a back-to-back compressor, comprising:

first and second annular body sections positioned coaxially and spaced axially apart and configured to be disposed in an interior chamber of the compressor; and first and second tubular body sections extending between the first and second annular body sections, the first tubular body section at least partially defining a first axial transfer channel, and the second tubular body section at least partially defining a second axial transfer channel, the first and second tubular body sections being circumferentially spaced apart and defining a radial outlet channel therebetween, wherein the first and second axial transfer channels are configured to direct fluid from a first compression assembly toward a second compression assembly, and the radial outlet channel is configured to direct fluid from the second compression assembly toward an outlet of the compressor.

12. The fluid channeling device of claim 11, wherein the radial outlet channel is axially defined between the first and second annular body sections.

13. The fluid channeling device of claim 11, wherein:

the first and second tubular body sections each have first and second open ends and a central bore extending therebetween;

the first annular body section defines first and second openings and the second annular body section defines third and fourth openings;

the first open end of the first tubular body section is disposed in the first opening and the second open end of the first tubular body section is disposed in the third opening; and the first open end of the second tubular body section is disposed in the second opening and the second open end of the second tubular body section is disposed in the fourth opening.

14. The fluid channeling device of claim 13, wherein the central bore has a major diameter and a minor diameter, wherein a ratio of the length of the major diameter to the minor diameter is about 2:1.

15. The fluid channeling device of claim 11, wherein the first tubular body section has an aerofoil-shaped, enclosed sidewall.

16. The fluid channeling device of claim 11, wherein at least one of the first and second compression assemblies includes one or more impellers.

17. A method for channeling fluid in a compressor, comprising:

directing a fluid from a first compression assembly to a channeling body having first and second annular body sections and tubular body sections extending therebetween;

directing the fluid through axial transfer channels extending through the first and second annular body sections and the tubular body sections;

directing the fluid from the axial transfer channels to a second compression assembly;

directing the fluid from a discharge fluidly coupled to the second compression assembly to the channeling body; and directing the fluid radially outward between the first and second annular bodies and between the tubular body sections to a compressor outlet.

18. The method of claim 17, wherein directing fluid through the axial transfer channels comprises directing fluid through first openings defined in the first annular body section of the channeling body, through the tubular body sections which are fluidly coupled to the first openings, and through second openings defined in the second annular body section and fluidly communicating with the tubular body sections.

19. The method of claim 18, further comprising preventing fluid in the axial transfer channels from intermixing with fluid in the radial outlet channels.

20. The method of claim 19, further comprising maintaining the fluid within a compressor casing while directing the fluid from the first compression assembly to the second compression assembly and while directing the fluid from the second compression assembly to the compressor outlet, the first and second compression assemblies and the channeling body being positioned in the compressor casing.

* * * * *